United States Patent [19]

Suzuki

[11] Patent Number: 4,952,473

[45] Date of Patent: Aug. 28, 1990

[54] PHOTOSENSITIVE MEMBER FOR ELECTROPHOTOGRAPHY

[75] Inventor: Akio Suzuki, Tokyo, Japan

[73] Assignee: Canon Kabushiki Kaisha, Tokyo, Japan

[21] Appl. No.: 381,993

[22] Filed: Jul. 17, 1989

Related U.S. Application Data

[63] Continuation of Ser. No. 83,001, Aug. 5, 1987, abandoned, which is a continuation of Ser. No. 728,160, Apr. 30, 1985, abandoned, which is a continuation of Ser. No. 534,314, Sep. 21, 1983, abandoned.

[30] Foreign Application Priority Data

Sep. 27, 1982 [JP] Japan ..... 57-166675

[51] Int. Cl.[5] ..... G03G 5/14; G03G 5/082

[52] U.S. Cl. ..... 430/67; 430/56; 430/66

[58] Field of Search ..... 430/56, 66, 67

[56] References Cited

U.S. PATENT DOCUMENTS

| | | | |
|---|---|---|---|
| 2,886,434 | 5/1959 | Owens | 430/67 |
| 3,650,737 | 3/1972 | Maissel et al. | 430/67 |
| 3,810,759 | 5/1974 | Stahr et al. | 430/56 X |
| 4,076,564 | 2/1978 | Fisher | 430/56 X |
| 4,265,991 | 5/1981 | Hirai et al. | 430/67 X |
| 4,394,426 | 7/1983 | Shimizu et al. | 430/66 X |
| 4,551,406 | 11/1985 | Schaedlich et al. | 430/56 X |

FOREIGN PATENT DOCUMENTS

| | | | |
|---|---|---|---|
| 57532 | 8/1982 | European Pat. Off. | 430/67 |
| 39-17748 | 8/1964 | Japan | 430/56 |
| 50-8533 | 1/1975 | Japan | 430/56 |
| 53-92133 | 8/1978 | Japan | 430/66 |

*Primary Examiner*—Roland E. Martin

*Attorney, Agent, or Firm*—Fitzpatrick, Cella, Harper & Scinto

[57] ABSTRACT

A photosensitive member for electrophotography comprises a photoconductive layer on an electroconductive substrate, said photoconductive layer being provided with a light scattering means having light scattering function.

7 Claims, 2 Drawing Sheets

PHOTOSENSITIVE MEMBER FOR ELECTROPHOTOGRAPHY

This application is a continuation of application Ser. No. 083,001 filed Aug. 5, 1987, now approved, which in turn, is a continuation of application Ser. No 728,160 filed Apr. 30, 1985 now abandoned which in turn, is a continuation of application Ser. No. 534,314, filed Sept. 21, 1983 now abandoned.

BACKGROUND OF THE INVENTION

1. Field of the Invention

This invention relates to a photosensitive member to be mounted in electrophotographic devices and others, particularly a photosensitive member which is inhibited from interference of the incident light within the photosensitive member.

2. Description of the prior Art

Laser beam printing comprises a combination of electrophotographic technique and laser technique, in which images are written by laser beam on a charged photosensitive drum to form latent images, which are in turn developed by a toner and transferred onto a transfer paper to obtain a hard copy. Since a laser beam printer is a non-impact printer, it has the advantages of smaller noise, capability of speed-up, higher quality of printed letters as compared with other non-impact printers and availability of plain papers.

However, since a laser beam is a coherent light, depending on the constitution of the photosensitive member of a photosensitive drum, multiple reflections of laser beam may occur within the photosensitive member to form interference pattern, which will disadvantageously appear on the images.

For example, as shown in the sectional view of the portion of the photosensitive drum of the prior art in FIG. 1, we now hypothesize the case in which laser beam 13*a* is irradiated on the photosensitive member 1 having a photoconductive member 12 provided on an electroconductive conductive substrate 11. A laser beam consists primarily of waves with longer wavelengths and the photosensitivity of the photoconductive member 12 is frequently low relative to the light with longer wavelengths such as the laser beam 13*a*. In other words, the photoconductive layer 12 is smaller in absorption of the laser beam 13*a* and high in transmittance thereof. In such a case, the laser beam 13*a* incident on the photosensitive member 1 reaches the interface between the photoconductive layer 12 and the electroconductive substrate 11, where it is reflected and reaches the interface point 14.

On the other hand, the laser beam 13*b* which is allowed to scan over the photosensitive member 1, enter the photoconductive layer 12 at the interface point 14 and be reflected against the interface of the electroconductive substrate 11, will disadvantageously interfere with the laser beam 13*a* which is reflected against the aforesaid interface of the electroconductive substrate 11 and reaches the interface point 14 of the photoconductive layer 12. Such an interference of laser beam will occur over the entire surface of the photosensitive member 1 of the photosensitive drum to form a speckled pattern as the result of the interference of laser beam as described above, thus giving rise to density irregularity in the images as the final toner images. In order to overcome such a drawback of the prior art, a proposal has been made to roughen the surface of the electroconductive substrate of the photosensitive member, thereby causing scattered reflection of the light incident on the surface and preventing interference with the light entering the photosensitive member and reflecting from the substrate. However, in a photosensitive member with such a constitution, namely a constitution having an electroconductive substrate with a roughened surface and a photoconductive layer on this substrate, the photoconductive layer may become lower in resistance, depending on the kind of the photoconductive layer employed. As the result, charges are injected from the surface of the photosensitive member into the inner portion thereof, whereby density irregularity is disadvantageously created to form no clear image.

SUMMARY OF THE INVENTION

The present invention has been accomplished in order to overcome the above drawbacks in view of the points as mentioned above, and it is an object of the present invention to provide a photosensitive member for electrophotography which is substantially free from occurrence of an interference action based on the reflection internally of the photoconductive layer even by use of a coherent light.

Another object of the present invention is to provide a photosensitive member comprising a photoconductive member provided on an electroconductive substrate, said member having a blocking layer having light scattering action provided on the photoconductive layer, whereby no interference action occurs even by use of a laser beam to give clear images without irregularity in density.

According to an aspect of the present invention, there is provided a photosensitive member for electrophotography comprising a photoconductive layer on an electroconductive substrate, said photoconductive layer being provided with a light scattering means having light scattering function.

According to another aspect of the present invention, there is provided an electrophotographic system comprising an electroconductive substrate, a photoconductive layer containing an amorphous silicon formed on said electroconductive substrate, and a light scattering layer provided on the surface of said photoconductive layer.

DETAILED DESCRIPTION OF THE INVENTION

Figure 1:
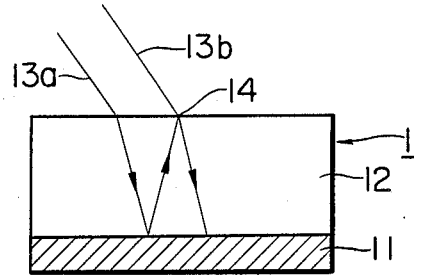
FIG. 1 shows a sectional view of a photosensitive member of the prior art.

Referring now to the drawings, the embodiments of the present invention are to be described in detail.

Figure 2:
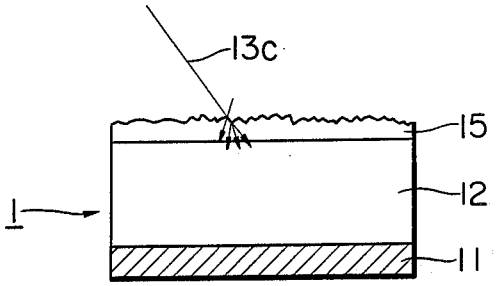
FIG. 2 shows a sectional view of a photosensitive member according to the present invention.

FIG. 2 shows a sectional view of one embodiment of the photosensitive member according to the present invention, in which 11 is an electroconductive substrate, 12 is a photoconductive layer and 15 is a blocking layer. The blocking layer 15 is a layer having the function to impede injection of charges from the surface of the photosensitive member 1 into the inner portion of the photosensitive member 1, when said photosensitive member is charged, and it may be constituted of, for example, silicon carbide and the like, when the photoconductive layer 12 is an amorphous silicon. If the electroconductive substrate of a photosensitive drum as of the prior art has a rough surface, crystallization occurs to be lowered in resistance, whereby density irregularity will occur on image formation. In contrast, in the case of the photosensitive member 1 having such a constitution of the present invention, no crystallization occurs to maintain a high resistance. The blocking layer 15 has a rough surface with minute concaves and convexes, against which the incident light 13*c* of laser beam on the photosensitive member 1 is scattered to lose its coherence. For this reason, no interference occurs within the photosensitive member as described with reference to FIG. 1 to give clear images without density irregularity.

Figure 3:
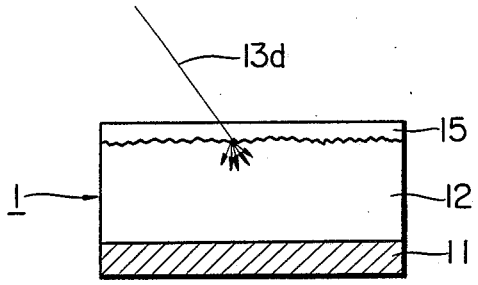
FIGS. 3, 4 and 5 show sectional view of other embodiments of the photosensitive member according to the present invention.

FIG. 3 shows a sectional view of another embodiment of the photosensitive member according to the present invention, wherein 15 is a blocking layer, 12 is a photoconductive layer, and fine concaves and convexes are formed at the interface between these layers, but the other face of the blocking layer 15 is smooth. 11 shows an electroconductive substrate.

Also in this case, the incident light 13*d* of the laser beam on the photosensitive member 1 is scattered by the fine concaves and convexes at the interface between the blocking layer 15 and the photoconductive layer 12 to lose its coherence, whereby no interference occurs internally of the photosensitive member comprising the photoconductive layer 12 and the electroconductive substrate 11 to result in clear images without density irregularity.

Figure 4:
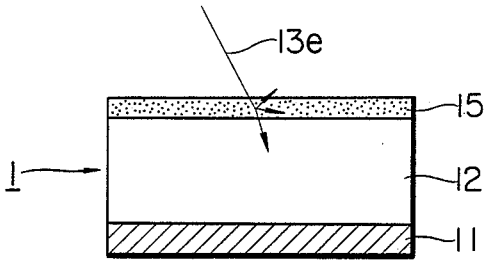

FIG. 4 shows a sectional view of still another embodiment of the present invention, wherein 15 is a blocking layer having a large number of minute particles dispersed in a resin binder to make the whole blocking layer a light scattering layer. As the dispersed particles, there may be employed, for example, minute particles of Teflon. 12 is a photoconductive layer and 11 is an electroconductive substrate. The incident light 13*e* of the laser beam on the photosensitive member is scattered by the minute particles within the blocking layer 15 when passing through the blocking layer 15 to lose its coherence, thus causing no interference internally of the photosensitive member 1. As the result, clear image without density irregularity can be obtained.

Figure 5:
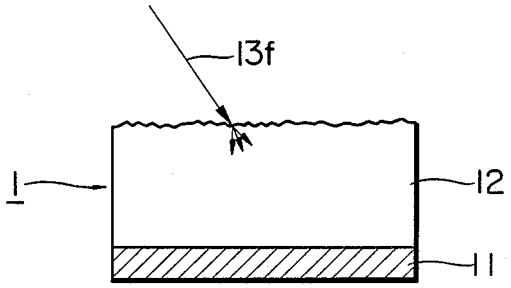

FIG. 5 shows a sectional view of still another embodiment of the present invention, wherein the photoconductive layer has a high resistance and substantially no injection of charges occurs when said layer is charged, whereby no blocking layer is particularly required, 11 being an electroconductive substrate and 12 a photoconductive layer. When fine concaves and convexes are formed on the surface of the photoconductive layer 12 to make it a rough surface, the incident light 13*f* of the laser beam on the photosensitive member 1 is scattered by the concaves and convexes on the surface of the photoconductive layer 12 to lose its coherence to give clear images without density irregularity due to interference within the photosensitive member 1.

In each embodiment as described above, by scattering of the incident light, resolution is generally lowered. However, lowering in resolution can be suppressed to the extent that it creates no practical problem by forming a thin film of the blocking layer and a thin film of the photoconductive layer at the light scattering layer region, thereby preventing divergence of the light scattered.

In the present invention, when light scattering performance is imparted by forming the surface of another surface provided on the photoconductive layer, the interface between the photoconductive layer and another layer or the surface of the photoconductive layer in shape of fine concavo-convex irregularities, as in case of the embodiments shown in FIG. 2, FIG. 3 and FIG. 5, the extent of such a concavo-convex should be more rough than the wavelength of light as its lower limit. On the other hand, its upper limit should desirably be sufficiently fine as compared with the particle size of the developer employed.

In the present invention, as the material constituting the photoconductive layer, various photoconductive materials for electrophotography may be variable, but it is desirable to use a photoconductive material having layers formed according to the so called vacuum deposition film forming method. As such materials, there may be employed chalocogen type photoconductive materials such as of Se, SeTe, etc., amorphous silicons containing hydrogen atoms or/and halogen atoms (written as "a-Si(H, X)"). Particularly a-Si(H, X) may preferably be employed as the photoconductive material in the present invention.

When the photoconductive layer is constituted of a-Si(H, X), the amount of hydrogen atoms or/and halogen atoms contained in said layer may preferably be 1 to 40 atomic %.

Figure 6:
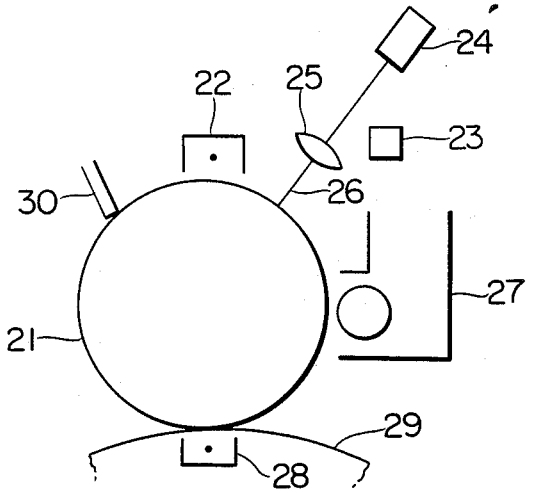
FIG. 6 shows a schematic illustration of a laser printer using an electrophotographic system according to the present invention.

FIG. 6 shows a schematic illustration of the laser printer having the photosensitive drum according to the present invention, wherein 21 is the photosensitive drum according to the present invention, 22 is a charger, 23 is a laser, 24 is a rotational polygonal body, 25 is an optical device, 26 is laser beam, 27 is a developing device, 28 is a transfer charger, 29 is a transfer paper and 30 is a cleaning device.

The photosensitive member 21 is uniformly charged by means of the charger 22 and then subjected to imagewise exposure by the laser beam 26 to form latent images thereon. Subsequently, the latent images are visualized by the developing device 27, followed by transfer of the images by means of the transfer charger 28 onto the transfer paper 29. The residual toner on the drum is cleaned by means of the cleaning device 30.

The present invention can be constituted and actuated as described above to enable prevention of interfering action of the incident light within the photosensitive member and obtainment of clear images without density irregularity due to interference patterns Moreover, since a high resistance photoconductive layer without crystallization can be formed irrespective of the material employed for the photoconductive layer, no injection of charges into said layer occurs to give images without density irregularity, and at the same time there is an additional effect of no restriction with respect to the material for the photoconductive layer.

What I claim is:

1. An electrophotographic photosensitive member for use with a developer comprising, in sequence, an electroconductive substrate, a photoconductive layer comprising amorphous silicon containing at least one of a hydrogen atoms and halogen atoms, wherein the total content of said hydrogen and halogen atoms is one to forty atomic percent, and a light scattering means on said photoconductive layer capable of scattering coherent light, said light scattering means having fine concave-convex irregularities with dimensions greater than the wavelength of the incident light to be scattered, but sufficiently fine as compared with the particle size of the developer.

2. An electrophotographic photosensitive member for use with a developer comprising, in sequence, an electroconductive substrate, a photoconductive layer containing amorphous silicon containing at least one of hydrogen atoms and halogen atoms, wherein the total content of said hydrogen and halogen atoms is one to forty atomic percent and a light scattering means on said photoconductive layer capable of scattering coherent light, said light scattering means having fine concave-convex irregularities with dimensions greater than the wavelength of the incident light to be scattered, but sufficiently fine as compared with the particle size of the developer, wherein said light scattering means is provided as a layer on the surface of said photoconductive layer.

3. A photosensitive member for electrophotography according to claim 1, wherein the said light scattering means is a rough surface of said photoconductive layer, having fine concaves and convexes.

4. An electrophotographic system according to claim 2, wherein the light scattering layer has an electrical blocking function.

5. A electrophotographic photosensitive member according to claim 1 wherein the light scattering means is on a surface of an electrical blocking layer on the photoconductive layer.

6. A photosensitive member for electrophotography according to claim 5, wherein said light scattering means is a rough surface formed at an interface between the photoconductive layer and the electrical blocking layer.

7. An electrophotographic photosensitive member according to claim 2 wherein the light scattering layer comprises silicon carbide.

* * * * *

UNITED STATES PATENT AND TRADEMARK OFFICE
CERTIFICATE OF CORRECTION

PATENT NO. : 4,952,473

DATED : August 28, 1990

INVENTOR(S) : AKIO SUZUKI

It is certified that error appears in the above-identified patent and that said Letters Patent is hereby corrected as shown below:

COLUMN 1

Line 6, "now approved," should read --now abandoned--.
Line 41, "conductive" should be deleted.

COLUMN 2

Line 52, "view" should read --views--.

COLUMN 4

Line 18, "variable," should read --employed,--.
Line 20, "so called" should read --so-called--.
Line 65, "a" should be deleted.

COLUMN 5

Line 2, "cave-convex" should read --cavo-convex--.
Line 15, "cave-convex" should read --cavo-convex--.

UNITED STATES PATENT AND TRADEMARK OFFICE

CERTIFICATE OF CORRECTION

PATENT NO. : 4,952,473

DATED : August 28, 1990

INVENTOR(S) : AKIO SUZUKI

It is certified that error appears in the above-identified patent and that said Letters Patent is hereby corrected as shown below:

COLUMN 6

Line 8, "A" should read --An--.
Line 9, "claim 1" should read --claim 1,--.
Line 18, "claim 2" should read --claim 2,--.

Signed and Sealed this

Seventeenth Day of March, 1992

*Attest:*

HARRY F. MANBECK, JR.

*Attesting Officer*

*Commissioner of Patents and Trademarks*